US010736393B2

(12) United States Patent
Cezeaux et al.

(10) Patent No.: US 10,736,393 B2
(45) Date of Patent: Aug. 11, 2020

(54) ASSISTIVE DEVICE FOR CARD RETRIEVAL

(71) Applicants: Western New England University, Springfield, MA (US); American International College, Springfield, MA (US)

(72) Inventors: Judy L. Cezeaux, Wilbraham, MA (US); Patricia Fatima Dos Santos, Cranston, RI (US); Joseph Salvatore Gucciardi, Springfield, MA (US); Dimitrios John Kastrinakis, South Hadley, MA (US); Patricia Ann Meyers, Leicester, MA (US)

(73) Assignees: WESTERN NEW ENGLAND UNIVERSITY, Springfield, MA (US); AMERICAN INTERNATIONAL COLLEGE, Springfield, MA (US)

( * ) Notice: Subject to any disclaimer, the term of this patent is extended or adjusted under 35 U.S.C. 154(b) by 172 days.

(21) Appl. No.: 15/949,210

(22) Filed: Apr. 10, 2018

(65) Prior Publication Data

US 2018/0289125 A1 Oct. 11, 2018

Related U.S. Application Data

(60) Provisional application No. 62/484,053, filed on Apr. 11, 2017.

(51) Int. Cl.

| | |
|---|---|
| ***A45C 11/18*** | (2006.01) |
| ***A45C 1/06*** | (2006.01) |
| ***A45C 13/00*** | (2006.01) |

(52) U.S. Cl.

CPC ..... *A45C 11/182* (2013.01); *A45C 1/06* (2013.01); *A45C 13/00* (2013.01); *A45C 13/001* (2013.01); *A45C 2001/065* (2013.01)

(58) Field of Classification Search

CPC . A45C 11/18; A45C 11/182; A45C 2011/188; A45C 13/00; A45C 13/001; A45C 13/02; A45C 13/026; B66F 19/00; B66F 13/00

See application file for complete search history.

(56) References Cited

U.S. PATENT DOCUMENTS

| | | | | |
|---|---|---|---|---|
| 1,413,698 A * | 4/1922 | Adams | B25B 23/0035 | 81/177.5 |
| 6,044,508 A * | 4/2000 | Chuang | B25B 27/0071 | 157/1.3 |
| 6,427,836 B1 * | 8/2002 | Bolanos | A45C 11/182 | 150/148 |

(Continued)

OTHER PUBLICATIONS

International Search Report and Written Opinion for International Application No. PCT/US2018/026804 dated Aug. 13, 2018; 7 pgs.

*Primary Examiner* — Tyrone V Hall, Jr.
(74) *Attorney, Agent, or Firm* — Cantor Colburn LLP

(57) ABSTRACT

An assistive device and a method of facilitating removal of a card is provided. The assistive device includes a first portion and a second portion extending from a first end of the first portion. The second portion having a first surface arranged on an angle relative to the first portion. At least one pad is disposed on the second portion. A lip extends from a second end of the first portion, the lip having a width smaller than a thickness of the card.

13 Claims, 8 Drawing Sheets

(56) References Cited

U.S. PATENT DOCUMENTS

| | | | | |
|---|---|---|---|---|
| 7,043,800 | B2 * | 5/2006 | Moody | E05B 53/001 16/412 |
| D545,518 | S * | 6/2007 | Ayala | D32/40 |
| 8,152,050 | B2 * | 4/2012 | Busam | B42F 7/06 229/67.1 |
| 8,726,953 | B2 | 5/2014 | Paulsen | |
| 8,776,846 | B1 * | 7/2014 | Thompson | A45C 11/182 150/138 |
| D721,498 | S * | 1/2015 | Holt | D3/318 |
| 9,475,197 | B1 * | 10/2016 | McAuley | B25J 1/02 |
| 2005/0224149 | A1 * | 10/2005 | Tiscione | A45C 11/182 150/148 |
| 2005/0235427 | A1 * | 10/2005 | Halling | A47L 13/02 7/167 |
| 2010/0127225 | A1 * | 5/2010 | Mika-Duesler | A45C 11/182 254/1 |
| 2010/0139138 | A1 * | 6/2010 | Miadich | A45C 11/182 40/641 |
| 2011/0162766 | A1 * | 7/2011 | Paulsen | A45C 11/182 150/147 |
| 2013/0036637 | A1 * | 2/2013 | Mazursky | B42F 21/02 40/359 |
| 2013/0170938 | A1 * | 7/2013 | Lowden | B42F 21/06 414/800 |
| 2014/0203581 | A1 * | 7/2014 | Baker | A45C 1/00 294/137 |
| 2014/0345759 | A1 * | 11/2014 | Salyer | A45C 1/06 150/147 |
| 2016/0198839 | A1 * | 7/2016 | Jamison | A45C 1/06 294/156 |
| 2017/0039897 | A1 | 2/2017 | Simmons | |

* cited by examiner

ASSISTIVE DEVICE FOR CARD RETRIEVAL

CROSS REFERENCE TO RELATED APPLICATIONS

This application claims the benefit of U.S. Provisional Application Ser. No. 62/484,053 filed Apr. 11, 2017, the entire disclosure of which is incorporated herein by reference.

BACKGROUND

The subject matter disclosed herein relates to an assistive device, and in a particular to an assistive device that aids in the retrieval of a card from a container such as a wallet.

It is common for people to carry multiple cards to facilitate authentication and perform transactions in their daily lives. These cards, such as credit cards, bank cards, and drivers' licenses for example, provide information that allows for the transactions to be more quickly performed or for the other party to have some assurance of whom they are meeting. As the number of these cards has proliferated, containers have been developed that include space for the cards. These containers, such as wallets, pocketbooks, briefcases and the like, typically have slots or pockets that are sized to receive one or more cards.

For people who have diminished hand function, the retrieval of the card from the container may be difficult. Examples of diminished function include, hand impairments due to congenital health conditions or the aging process as well as acute or chronic injuries. These impairments may make manipulating the relatively thin card difficult or in some cases impossible. Thus, for people with diminished hand function, the use of cards in containers such as wallets may reduce their ability to act independently and may otherwise interfere with normal daily activities.

Accordingly, while existing assistive devices are suitable for their intended purposes the need for improvement remains, particularly in providing an assistive device that can be used to remove cards on an as needed basis.

BRIEF DESCRIPTION

According to one aspect of the disclosure an assistive device to facilitate removal of a card is provided. The assistive device includes a first portion and a second portion extending from a first end of the first portion. The second portion having a first surface arranged on an angle relative to the first portion. At least one pad is disposed on the second portion. A lip extends from a second end of the first portion, the lip having a width smaller than a thickness of the card.

According to another aspect of the disclosure a method of retrieving a card from a wallet is provided. The method includes inserting a first portion of an assistive device into a slot in the wallet containing the card, the first portion being inserted until a lip on an end of the first portion extends past an edge of the card. A second portion that extends from first portion is grasped, the second portion having a first surface arranged on an angle relative to the first portion. The second portion is pulled to remove the card from the wallet.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

Figure 1:
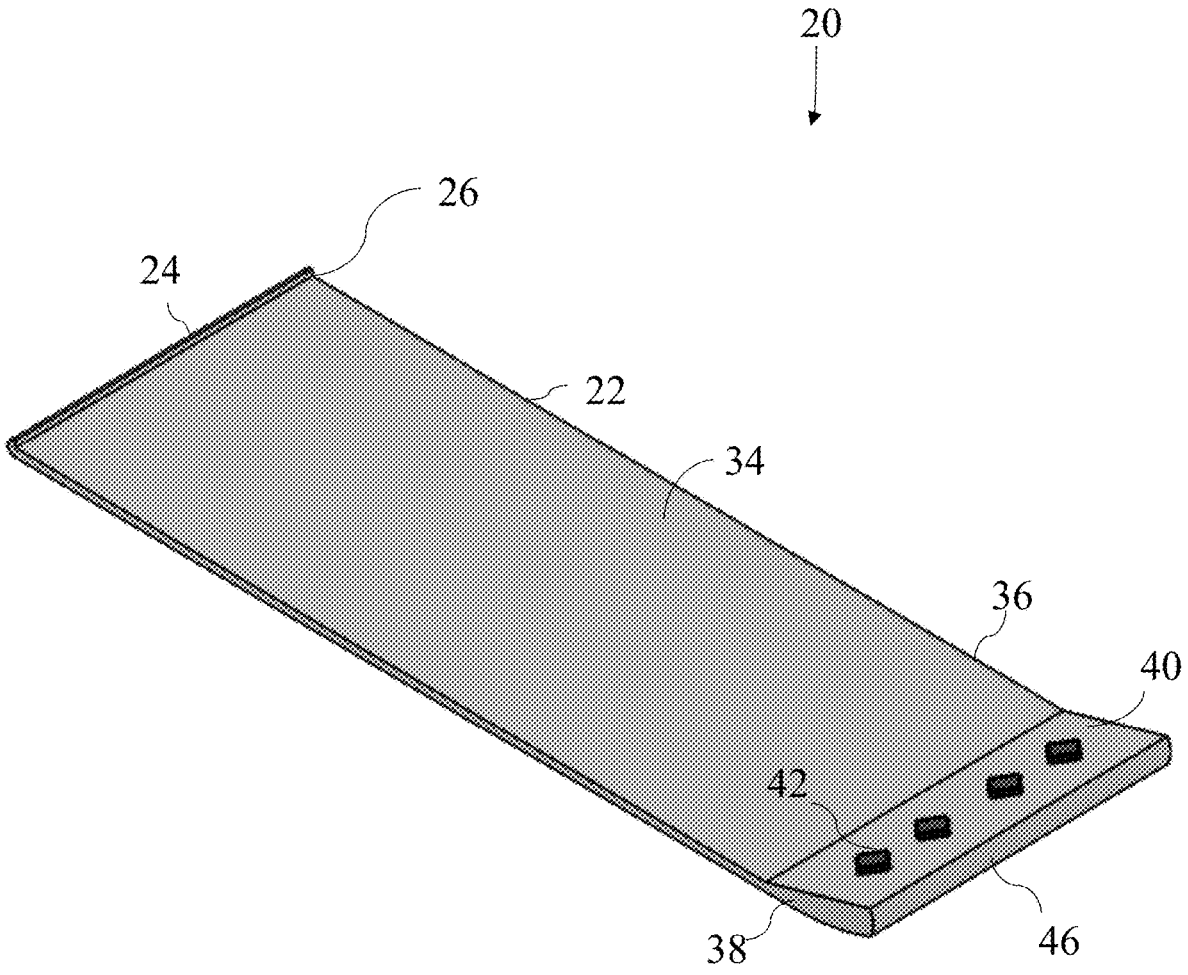
FIG. 1 is a perspective view of an assistive device in accordance with an embodiment.
Figure 2:
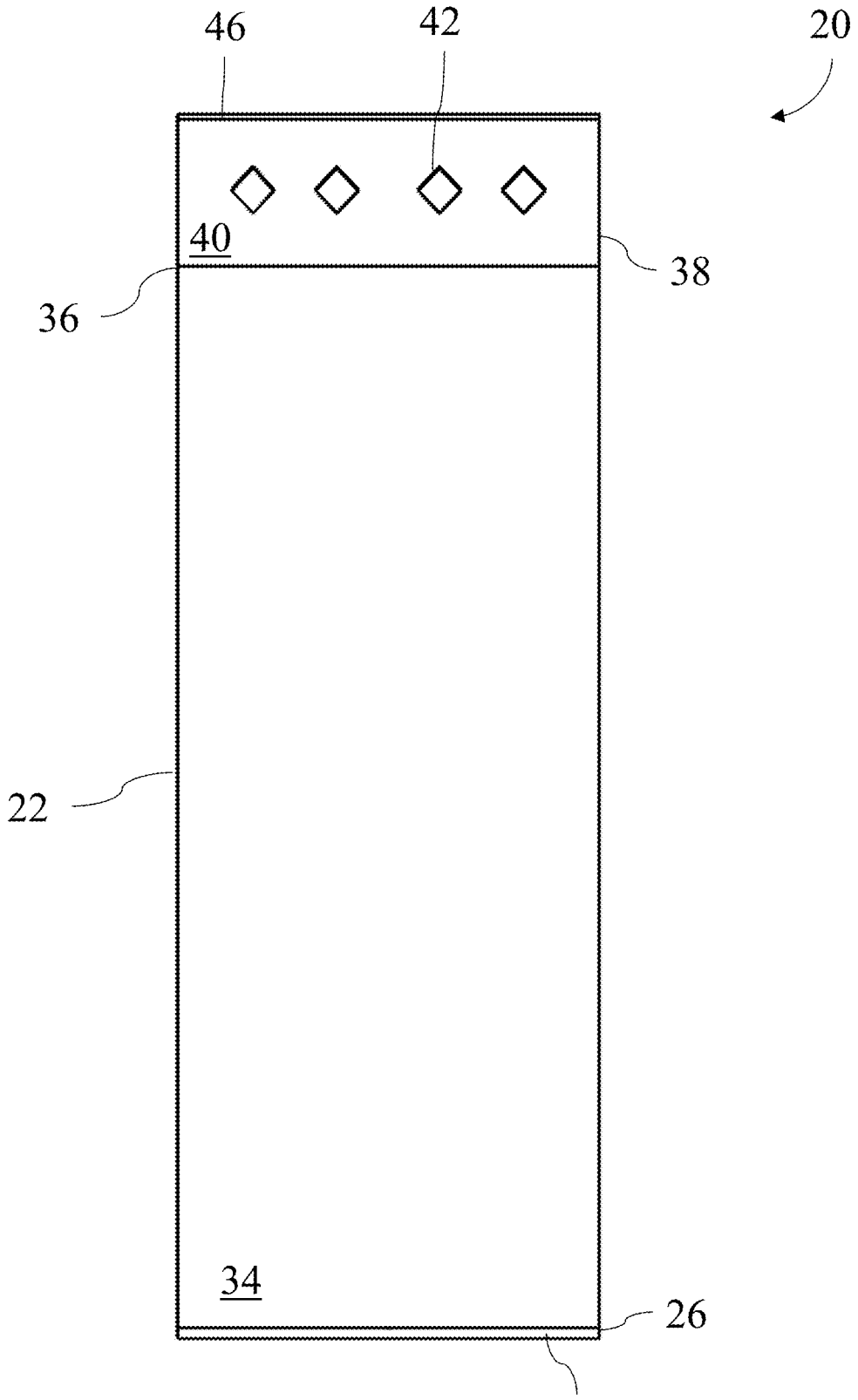
FIG. 2 is a front view of the assistive device of FIG. 1.
Figure 3:
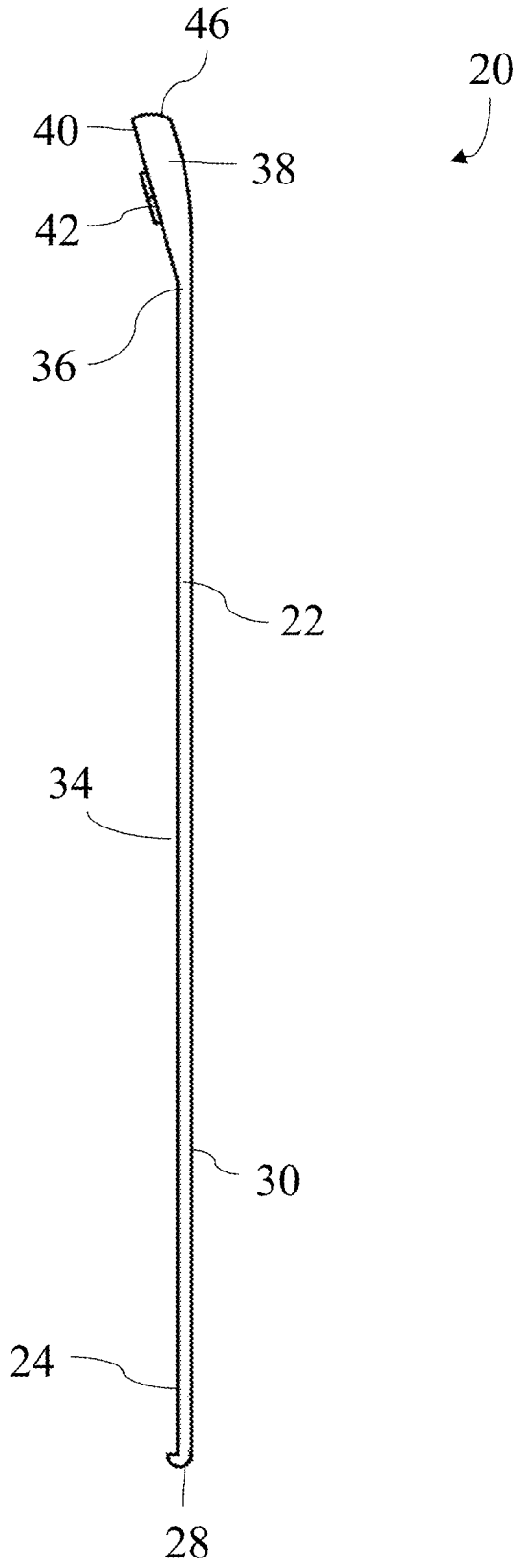
FIG. 3 is a side view of the assistive device of FIG. 1.
Figure 4:
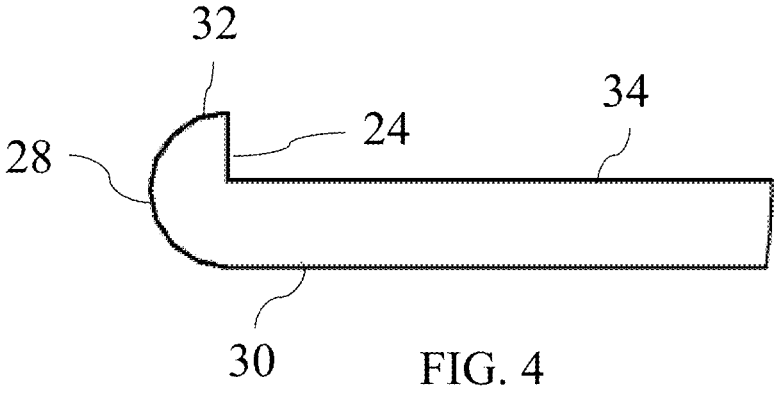
FIG. 4 is an enlarged side view of a first end of the assistive device of FIG. 1.
Figure 5:
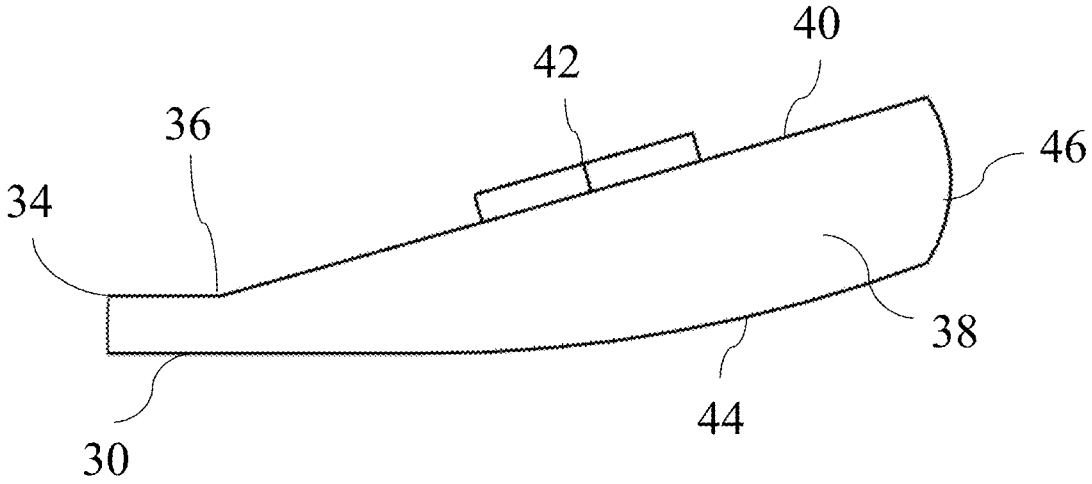
FIG. 5 is an enlarged side view of a second end of the assistive device of FIG. 1.

The detailed description explains embodiments of the disclosure, together with advantages and features, by way of example with reference to the drawings.

DETAILED DESCRIPTION

Embodiments of the present invention in an assistive device for people with diminished hand function, such as the ability to remove a card, such as a credit card or a bank card, from a container, such as a wallet. Embodiments of the present invention provide a person with diminished hand function with the ability to selectively remove a card from wallet.

Referring to FIGS. 1-5, an embodiment of an assistive device 20 that assists a person with diminished hand function to remove a card from a wallet. It should be appreciated that while embodiments herein refer to a wallet, this is for exemplary purposes and the claimed invention should not be so limited. In other embodiments, the assistive device may be used with any container having an enclosed slot, pouch or recess, such as but not limited to a pocketbook, purse, handbag, backpack, belt-fold, money-clip, cellular phone case, suitcase, brief-case, or messenger bag for example. Further, while embodiments herein refer to the card as a credit card or a bank card, this is for exemplary purposes and the claimed invention should not be so limited. In other embodiments, the card may be any thin planar member that may be stored in an enclosed slot (such as the slot in a wallet for example), such as but not limited to business cards, store reward cards, insurance ID cards, membership cards, library cards, and drivers' licenses for example.

The assistive device 20 includes a first portion 22 having a lip 24 arranged at a first end 26. In the exemplary embodiment, the first portion 22 is a generally thin planar body. In one embodiment, the first portion is 0.04 inches (1.02 millimeters) thick and has a length between 3.37-3.48 inches (85.6-88.4 millimeters). The first end 26 includes a semi-cylindrical surface 28 (FIG. 4) that extends between a rear surface 30 of first portion 22 and an edge 32 of lip 24. In the exemplary embodiment, the lip 24 has a width (from the edge 32 to a front surface 34 of the first portion 22) of 0.030 inches (0.76 millimeters). In an embodiment the width of the lip 24 is sized to be less than the width of a card being removed. It should be appreciated that this provides advantages in allowing the assistive device to be used with cards that are already positioned in the wallet and allows the assistive device to be used without prepositioning or precoupling with card. It should further be appreciated that this also provides advantages in allowing people with diminished hand function to selectively remove cards from their wallet.

Figure 6:
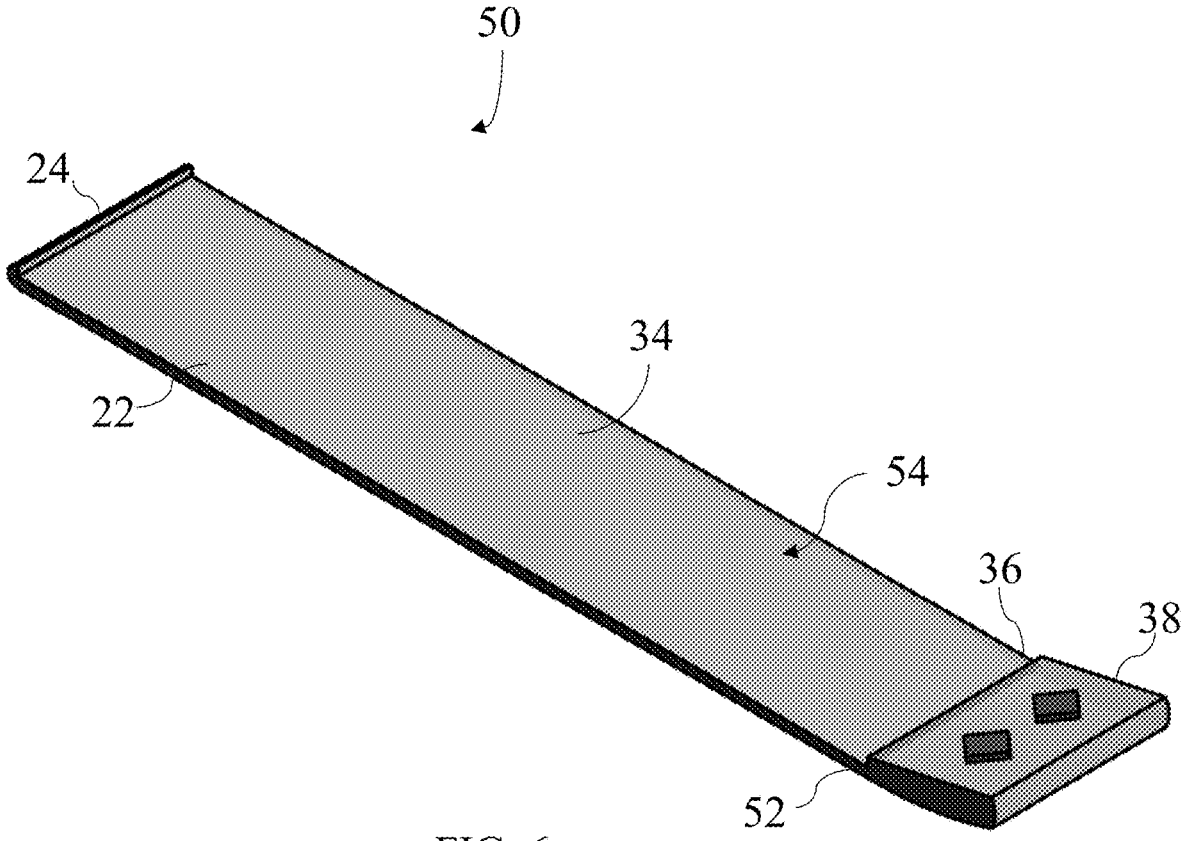
FIG. 6 is a perspective view of an assistive device in accordance with another embodiment.

Extending from an end 36 opposite the lip 24, the assistive device 20 includes a second portion 38. The second portion 38 includes a first surface 40 that extends on an angle relative to the front surface 34. In the exemplary embodiment, the first surface extends on an angle of between about 20°-30° relative to the plane of the first surface 40. In the embodiment of FIG. 1, the angle is about 25.7°. In the embodiment of FIG. 6, the angle is about 22.3°. The angle between the first surface 40 and the front surface 34 may provide a number of advantages, these advantages include but are not limited to: allowing for a visual differentiation that provides a visual confirmation on how far the assistive device was inserted; allows for a physical separation between a rear surface 44 and the wallet and other cards to assist in removal; allows the rear surface 30 to remain planar and the gripping portion to be thicker; provides leverage when removing the card; engages the users finger when pulling; and allows the wallet to be closed without impeding the users comfort or causing significant pressure on the device.

Arranged on the first surface 40 is at least one pad member 42. In the exemplary embodiment, a plurality of pad members 42 extend from the surface 40. The pad members 40 may be made from a relatively soft material, such an elastomer, rubber, or plastic for example, that allows the user to engage the pad member 42 with their hand or finger and aid them in grasping the assistive device 20. In the exemplary embodiment, the pad members 42 are a diamond shape. However, in other embodiments different shape pad members may be used. For example, at least one pad member 42 may be linear projection that extends transversely across the surface 40. In an embodiment, a plurality of different assistive devices may be used in a single wallet. In this embodiment, each assistive device 20 may have a different shape or different colors to allow the user to identify different cards.

Further, in still other embodiments, at least one pad member 42 may have a top surface that is level or flush with surface 40. In still further embodiments, at least one pad member 42 may be recessed into the surface 40. In yet still further embodiments, at least one pad member may be a recess in the surface 40.

In the exemplary embodiment, the second portion 38 includes a second surface 44 that extends from the surface 30 of first portion 22. The second surface 44 may have an arcuate shape that extends away from the plane defined by the surface 30. The second portion 38 further includes a curved third surface 46 that connects the rear surface 44 with the first surface 40. In an embodiment, the second portion 38 has a tapered shape that becomes thicker as the second portion 38 extends away from the first portion 22. In an embodiment, the thickness of the second portion 38 at the end adjacent to the curved surface 46 is 0.11 inches (2.8 millimeters).

In the exemplary embodiment, the assistive device 20 has a substantially constant width along the length. In an embodiment, the width of the assistive device 20 is between about 0.69-1.38 inches (17.5-35 millimeters). In an embodiment, the width of the assistive device is selected to allow access to cards stored in either a vertical or horizontal orientation. In an embodiment, the width of the assistive device 20 is about ⅔ the width of a standard size card, such as a credit card. This provides advantages in allowing insertion into the card holder slot on an angle and also allows the assistive device 20 to be moved within the card holder slot. In another embodiment, the width of the assistive device is about ⅓ the width of a standard card, which allows three assistive devices 20 to be coupled to three different cards while remaining fully visible from the front of the wallet. In an embodiment, the length of the first portion 22 is sized to allow the second portion 38 to be positioned outside of the outer edge of a wallet.

Referring now to FIG. 6, another embodiment of the assistive device 50 is shown. The assistive device 50 is substantially similar to the assistive device 20 except that it is smaller in width and the second portion 38 includes an end surface 52 at the junction with the end 36 of surface 34. The end surface 52 is arranged opposite the lip 24. The lip 24 and the end surface 52 cooperate to define a slot 54. It should be appreciated that the end surface 52 may provide additional advantages in allowing a user to push a card back into a slot in a wallet. Further, in some embodiments, the slot 54 is sized to closely fit the width of a desired card. Thus the slot would further help the user by holding the card once the card is removed from the wallet.

Figure 7:
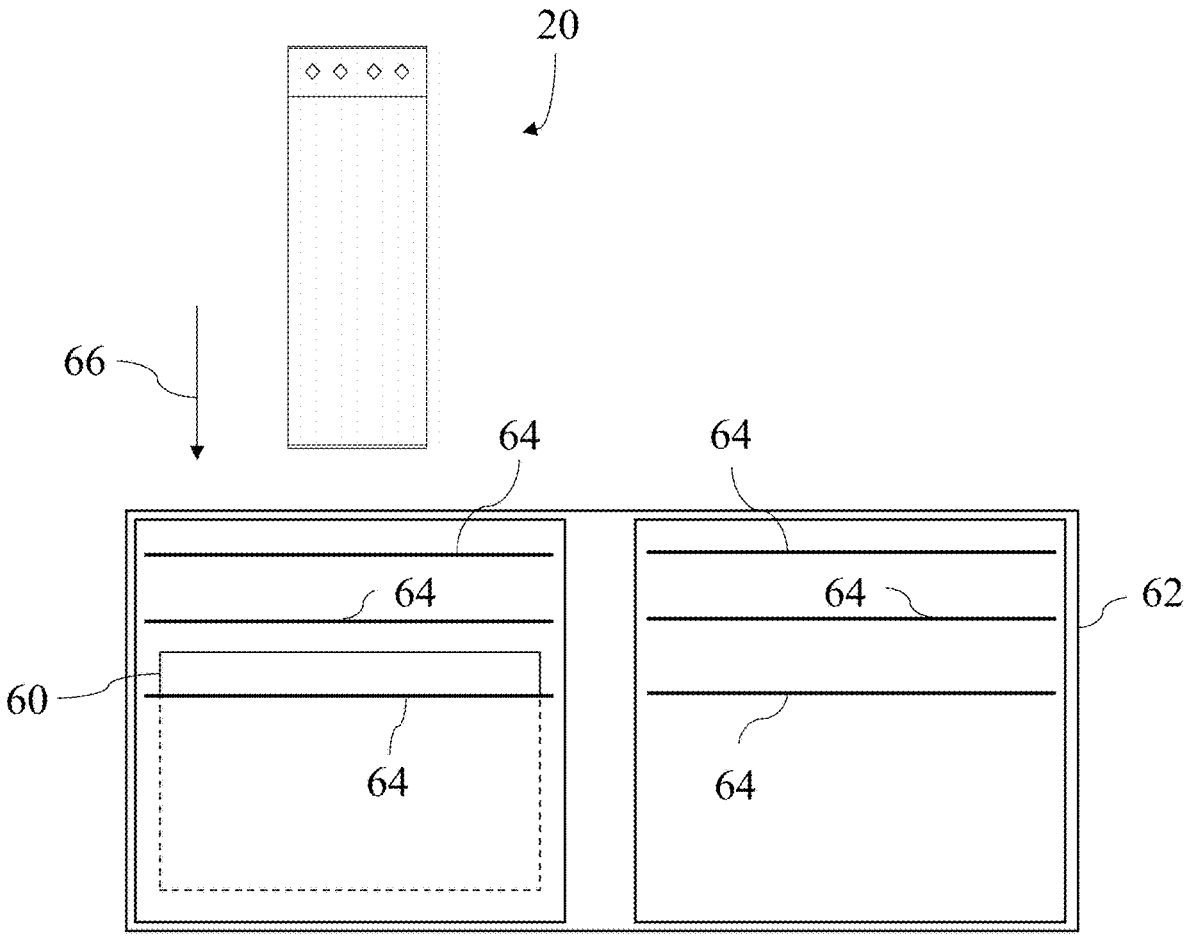
FIGS. 7-9 are illustrations of a method of using the assistive device of FIG. 1.
Figure 8:
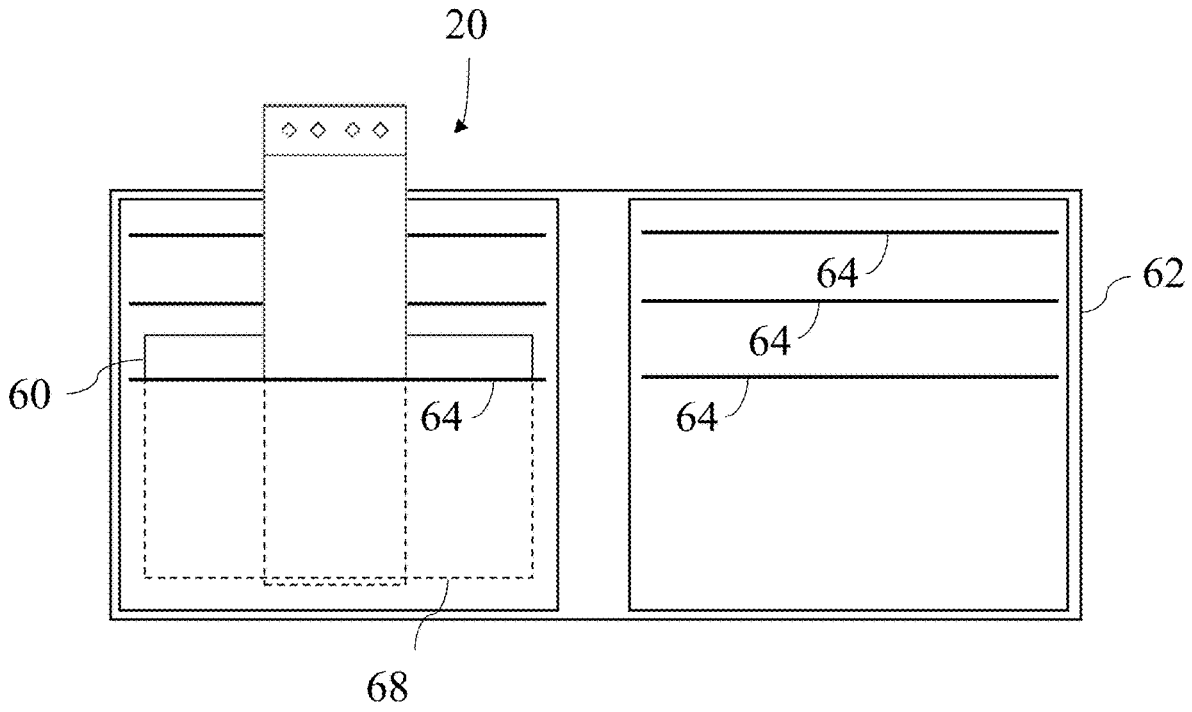
Figure 9:
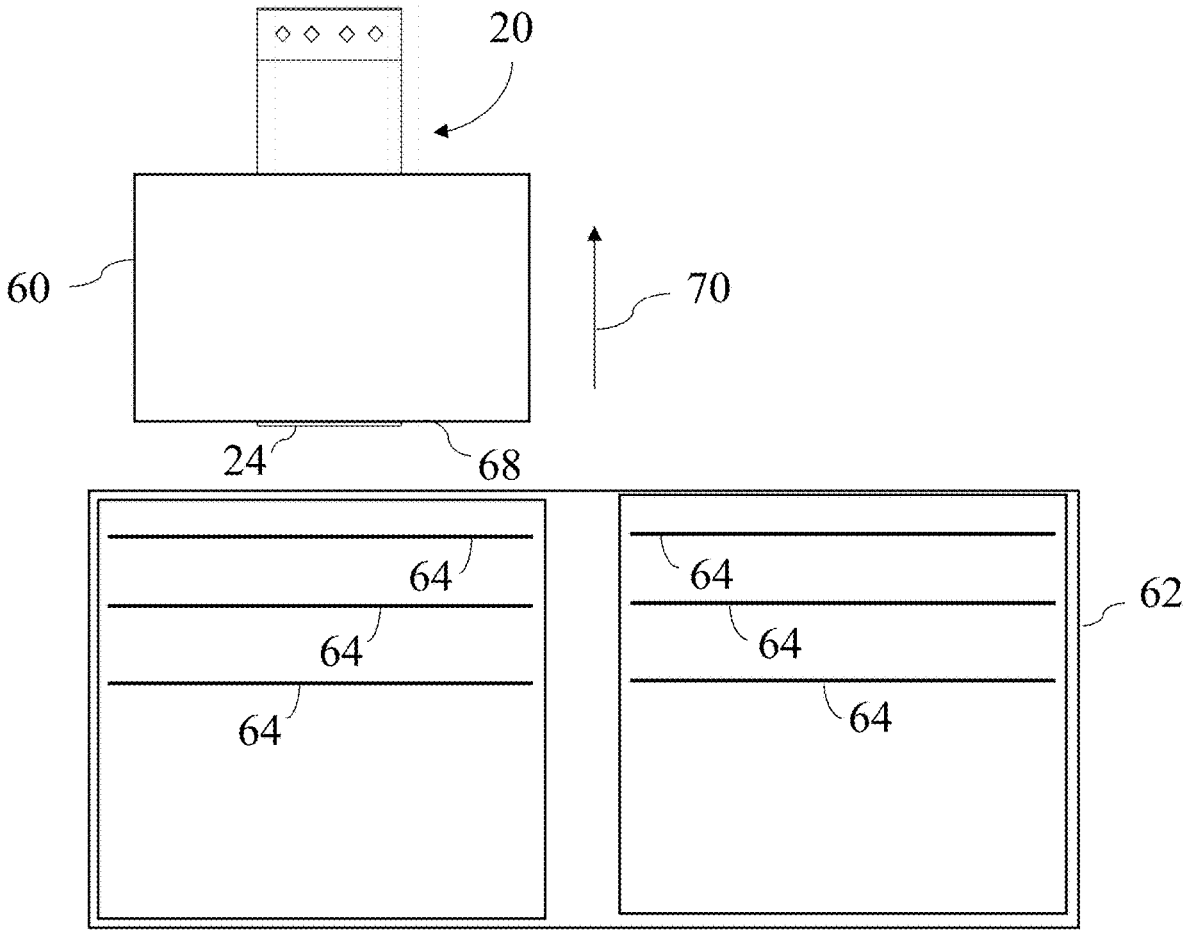

Referring now to FIGS. 7-9, a method is shown of retrieving a card 60 from a wallet 62. The wallet 62 includes at least one, and typically a plurality of spaces or slots 64 that are sized to receive cards that a typically carried by a user. Usually, the slots 64 are an enclosed space or pocket that is closely sized to hold the card securely and prevent the cards from inadvertently falling out. The slots 64 may be sized with a depth that allows a small portion of the card 60 to extend past a top edge of the slot.

The user first positions the assistive device 20 generally perpendicular to the slot 64 and the edge of the card 60. The user then moves the assistive device 20 in the direction indicated by arrow 66 to move the lip 24 towards the opening of the slot 64 that contains the card they want to remove. Once the lip 24 passes into the slot 64, the user continues to insert the assistive device 20 until the lip 24 extends past the lower or bottom edge 68 of the card 60 (FIG. 8). In an embodiment, the assistive device is made from a substantially rigid material that deflects slightly as the lip 24 passes over the face of the card 60 such that is snaps back as the lip 24 passes over the lower or bottom edge 68. In some embodiments, it has been found that this deflection and snapping back of the first portion 22 provides an audible sound provides feedback to the user that the assistive device 20 has engaged the card 60.

The users then pinch the second portion 38, such as by engaging their thumb or finger on the at least one pad 42, and move the assistive device 20 in the direction indicated by the arrow 70 (FIG. 9). As the assistive device 20 is moved, the lip 24 engages the edge 68 and moves the card 60 along with the assistive device 20. Once the card 60 is removed from the wallet 62, the users may then remove the card from the assistive device 20.

It should be appreciated that embodiments described herein provide advantages to persons with diminished hand function that prevent them from easily removing cards from card holders in containers such as wallets and pocketbooks, to improve persons' ability to independently perform daily tasks and be more self-sufficient.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An assistive device to facilitate removal of a card, the assistive device comprising:

a first portion, the first portion including a front surface and a back surface opposite the front surface;

a second portion extending from a first end of the first portion, the second portion having a first surface arranged on an angle relative to the first portion and a second surface opposite the first surface, the first surface planar and extending from the front surface, and the second surface arcuate and extending from the back surface;

at least one pad disposed on the second portion; and a lip extending from a second end of the first portion, the lip extending from the front surface, the lip configured to have a width smaller than a thickness of a card onto which the lip is engageable.

2. The assistive device of claim 1, wherein the at least one pad extends from the first surface.

3. The assistive device of claim 1, wherein the at least one pad includes a plurality of pads equally spaced across the width of the first surface.

4. The assistive device of claim 1, wherein the at least one pad has an end that is parallel with or is positioned below the first surface.

5. The assistive device of claim 1, wherein the second end includes a semi-cylindrical surface.

6. The assistive device of claim 1, wherein the second portion further includes a third curved surface extending between the first surface and the second surface.

7. The assistive device of claim 1, wherein the first portion has a first thickness and the second portion has a second thickness, the second thickness being larger than the first thickness.

8. The assistive device of claim 1, wherein the first portion and second portion have a length configured such that the second portion extends beyond an outer edge of a wallet containing the card when the lip is engaged to the card.

9. The assistive device of claim 1, wherein the second portion further includes an end surface, the end surface being arranged opposite the lip, the end surface and the lip cooperating to define a slot sized to receive the card.

10. A method of retrieving a card from a wallet, the method comprising:

inserting a first portion of an assistive device into a slot in the wallet containing the card, the first portion being inserted until a lip on an end of the first portion extends past an edge of the card, the first portion including a front surface and a back surface opposite the front surface, the lip extending from the front surface;

grasping a second portion that extends from first portion, the second portion having a first surface arranged on an angle relative to the first portion and a second surface opposite the first surface, the first surface planar and extending from the front surface, and the second surface arcuate and extending from the back surface; and pulling the second portion to remove the card from the wallet.

11. The method of claim 10, wherein the gasping of the second portion includes engaging the user's finger with at least one pad disposed on the first surface.

12. The method of claim 10, wherein the inserting of the first portion continues until the user hears an audible sound when the lip extends past the edge of the card.

13. The method of claim 10, wherein the inserting of the first portion occurs after the card is positioned in the wallet.

* * * * *